United States Patent [19]

Dacus

[11] Patent Number: 4,770,450

[45] Date of Patent: Sep. 13, 1988

[54] DOOR GUARD DEVICE FOR A MOBILE HOME

[76] Inventor: Wilton Dacus, Route 2, Box 401A, Pendleton, S.C. 29670

[21] Appl. No.: 36,716

[22] Filed: Apr. 10, 1987

[51] Int. Cl.[4] ..... E05C 19/18

[52] U.S. Cl. ..... 292/258

[58] Field of Search ..... 292/258, 259, 288

[56] References Cited

U.S. PATENT DOCUMENTS

| | | | |
|---|---|---|---|
| 1,239,802 | 9/1917 | Macbeth | 292/258 |
| 2,151,587 | 3/1939 | Cassileth | 292/288 |
| 4,004,833 | 1/1977 | Hull | 292/288 |
| 4,334,705 | 6/1982 | Rumph | 292/288 |

*Primary Examiner*—Richard E. Moore
*Attorney, Agent, or Firm*—Cort Flint

[57] ABSTRACT

A door guard device (A) for interlocking a door (10) surrounded by a door frame having a doorjamb (16) and a front facing (14) is disclosed. The device includes a first arm (22) with legs (24, 26) which straddle a doorknob (20). A second arm (28) extends perpendicular to the door and is joined by a third arm (30) parallel to the door and engaging front facing (14) to prevent outward door opening. A brace (32) holds the device in place and allows for loose tolerancing of the device to allow for placement in a quick and easy manner and on a variety of door designs.

15 Claims, 2 Drawing Sheets

DOOR GUARD DEVICE FOR A MOBILE HOME

BACKGROUND OF THE INVENTION

It is common for the exterior doors of mobile homes and the like to open outwardly. Due to the construction of the door structure which includes the door and associated door frame, this type of door is susceptible to break-in and entry. In particular, mobile home door structures are typically of lighter weight framing than conventional building doors. Because the doors open outwardly, they may be easily pried. Also, because the doors open outwardly, they are less easily guarded and locked by more conventional type door guards which prevent a door from being opened inwardly.

U.S. Pat. No. 4,334,705 discloses a door lock for an outwardly opening door which is adapted to fit into a corner between the doorjamb and the door. However, because of the wall type construction of the lock and its tight fit, adjustability need be made between the various wall structures of the lock resulting in a relatively complicated and expensive device for its function. Since the device must engage the front end of the doorjamb, its adjustability is relatively limited. Moreover, the adjustable features make the lock susceptible to loosening and failure. Due to the tight fit, the lock may not always be quickly changed out for repeated in and out use.

Accordingly, an object of the invention is to provide a simplified door guard for a mobile home door and other similar door structures which open outwardly.

Still another important object of the invention is to provide a door guard for an outwardly opening door which is of simplified construction and inexpensive, yet has sufficient tolerance to provide some adjustability for use.

SUMMARY OF THE INVENTION

The above objectives are accomplished according to the invention by providing a door guard device for locking an outwardly opening door of a mobile home and the like surrounded by a door frame having a side frame perpendicular to the door and a front facing parallel to the door. The device comprises a first elongated arm and a pair of spaced, depending legs integral with the first arm straddling the door knob. A second elongated arm is integral with the first elongated arm means and is joined perpendicular thereto. A first brace extending vertically from the second elongated arm means for embracing the doorjamb to hold the device in place. The second arm extends past the doorjamb to the front facing of the door frame. A third elongated arm perpendicular to the second arm engages the front facing of the door frame as the door is opened outwardly to prevent the same. The device need not fit in place tightly and is toleranced loosely for quick change out and accommodating some variances in door structure designs and dimensions.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
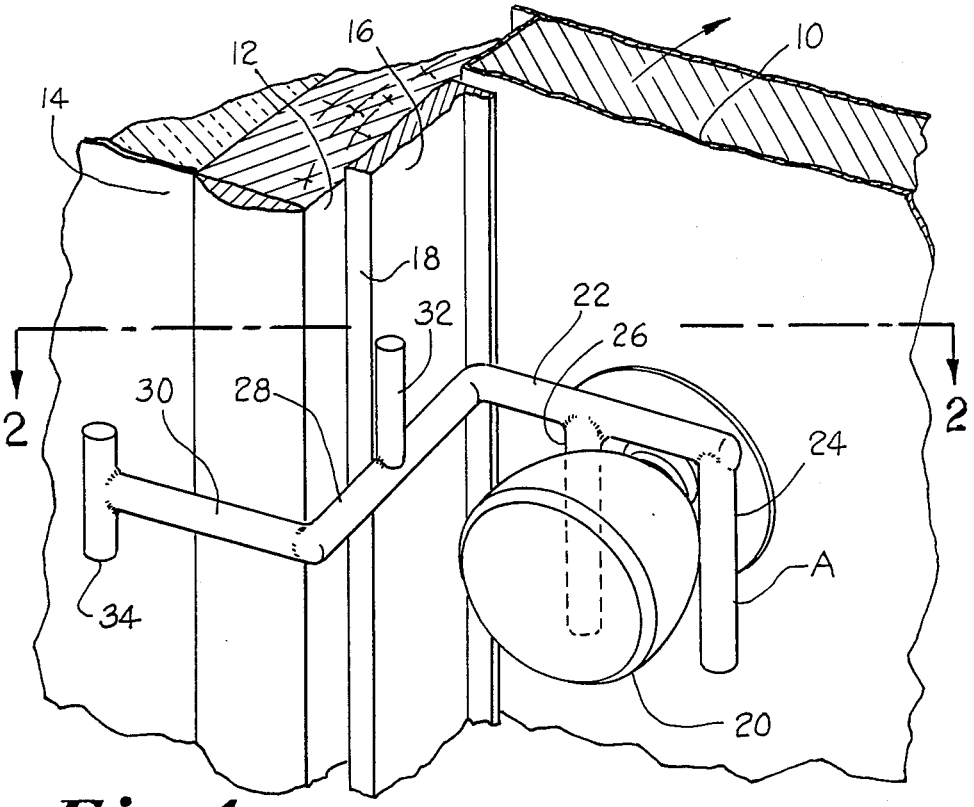
FIG. 1 is a perspective view illustrating a door guard device constructed in accordance with the invention and placed on an outwardly opening door.

Referring now in more detail to the drawings, a door structure is illustrated which is typical for an outwardly opening exterior door of a mobile home and the like. The door structure includes an outwardly opening exterior door 10 and a surrounding door frame. The door frame includes a side frame 12 and an interior front facing 14. A doorjamb 16 is carried flush with side frame 12 and terminates in a front edge 18 which is short of the front facing 14. A doorknob 20 is carried by door 10 on one side thereof having a shank 21 extending into the door. The opposing side of door 10 is affixed to the door frame by means of conventional hinges (not shown).

Figure 2:
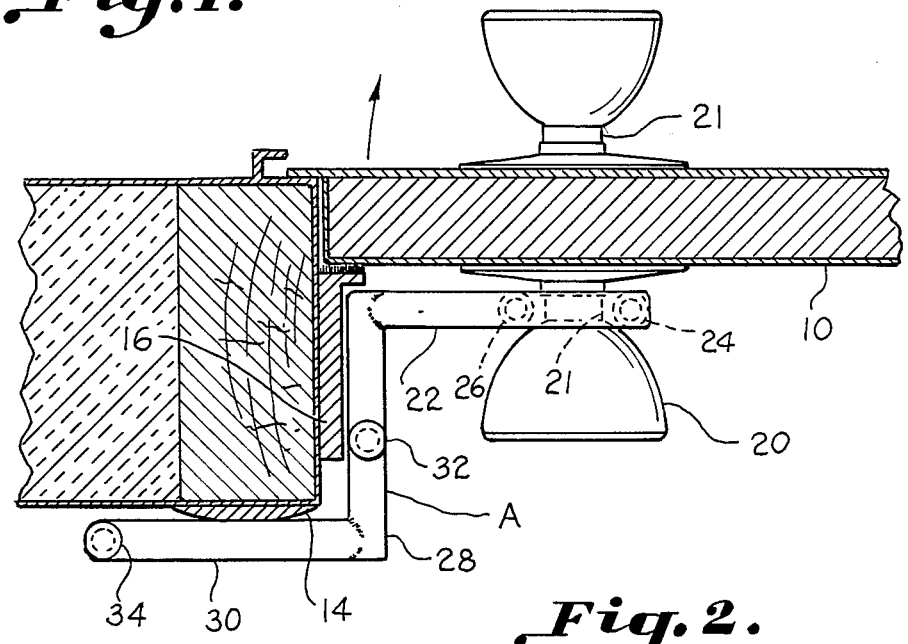
FIG. 2 is a sectional view taken along line 2—2 of FIG. 1.

As shown in combination with the door structure (FIG. 1), a door guard device A includes a first elongated arm 22 parallel to door 10. A pair of integral spaced legs 24 and 26 depend downwardly from arm 22 and are perpendicular thereto which straddle doorknob shank 21 behind the enlargement of doorknob 20. A second elongated arm 28 is integral with first arm 22. Second elongated arm 28 extends perpendicularly from first arm 22 and door 10 past doorjamb 16 terminating adjacent front facing 14 of the door frame. Second arm 28 abuts against the doorjamb (FIG. 2). A third elongated arm 30 extends from the free end of second arm 28 perpendicularly and engages front facing 14. There is a first brace means in the form of a post 32 which embraces doorjamb 16 to hold the door guard device in place. There is a second brace means in the form of a vertically extending post 34 carried at the free end at third elongated arm 30 for embracing front facing 14.

Brace means 32 and 34 hold door guard device A in place during use and brace means 34 adds some additional bracing against outward opening of the door as engaging front facing 14. First arm 22 and second arm 28 may be dimensioned to provide some tolerance between the device and doorknob 20 and front facing 14 so that some amount of adjustability is afforded for variances in door designs and dimensions. For example, doorknob placement 20 and the depth of door frame 12 may vary slightly. Door guard device A may be toleranced so that a somewhat loose fit is provided between these members yet the device is held in place by brace means 32 and somewhat by brace means 34, as can best be seen in FIGS. 1 and 2.

The distance from leg 26 to a second arm 28 is less than the distance from doorknob shank 21 to doorjamb 16. Second arm 28 is slightly longer than the depth of side frame 12 to door 10. This accommodates use of the device on various door structure designs and dimensions. As can be seen in FIG. 2, with door guard device A in place, even if the standard key door lock is overcome, outward opening of the door is prevented by the door guard device A. Since the door guard device can only be placed on the door from the inside, the owner may not be locked out by the device. The device may be removed quite readily and need not have a tight fit in order to be held in place. The device has loose tolerancing to fit door structures with some variances. The loose fit means that the door may be quickly positioned and removed for convenient and out use of the door. Yet, the device effectively locks the door against outward opening.

While shown on a door frame which a doorjamb as is most typical, the device can also readily fit a door structure without a doorjamb. In this case, brace 32 will lie against side frame 12. It will be noted that brace 32 prevents pivoting of hte device about the doorknob and brace 34 resists pivoting about an axis along first arm 20.

Figure 4:
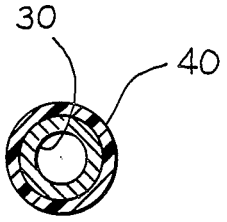
FIG. 4 is a sectional view taken along line 4—4 of FIG. 3.
Figure 3:
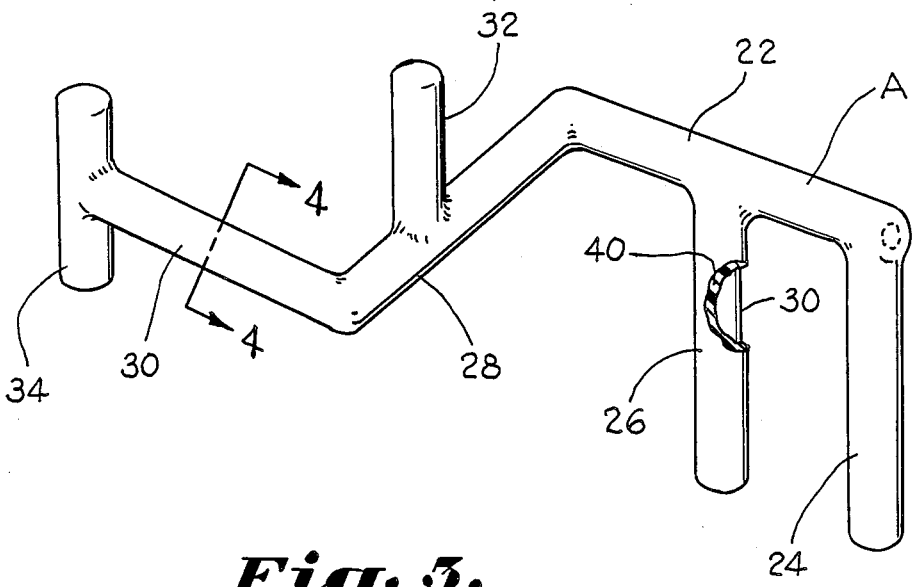
FIG. 3 is a perspective view of a door guard device constructed in accordance with the present invention.

As illustrated in FIG. 4, the device is of a welded construction with the various arms and braces being tubular material. This affords a sufficiently lightweight, but strong structure for guarding a door. Other materials and forms of construction may be had while still accomplishing the objectives and advantages of the invention. For example, a molded construction of lightweight, reinforced plastic materials may be utilized. It is also preferred that the guard door device have a rubber coating 40 to give the device a finished appearance and also assist in frictionally holding guard device A in place while positioned on a door. For this purpose, once the device is assembled, it may be dipped into a rubber coating material to provide an exterior layer 40 of a suitable rubber material.

While a preferred embodiment of the invention has been described using specific terms, such description is for illustrative purposes only, and it is to be understood that changes and variations may be made without departing from the spirit or scope of the following claims.

What is claimed is:

1. The combination of a door structure including a door which opens outwardly of an interior, a door frame surrounding said door having a side frame perpendicular to said door and a front facing parallel to said door carrying one side of said door secured to said door frame, a doorknob carried on said door adjacent a second opposing side of said door having a doorknob shank extending into the door, a door guard comprising: a first rod-like arm means having a pair of spaced depending leg means straddling said doorknob; a second rod-like arm means perpendicular to said first rod-like arm means and extending outwardly past said front facing engaging said side frame, a third rod-like arm means generally perpendicular to said second rod-like arm means and parallel to said front facing for engaging said front facing of said door frame, a first brace means extending vertically from said second rod-like arm means bracing against door side frame for holding said first, second, and third rod-like arm means in place between said door and door frame, to prevent opening of said door outwardly.

2. The door guard of claim 1 wherein said first, second, and third rod-like arm means are elongated.

3. The door guard of claim 1 including a second brace means extending vertically from said third leg means embracing said front facing of said door frame, while said second elongated rod-like arm means extends past said doorjamb, terminating adjacent said front facing.

4. The door guard of claim 1 wherein said first brace means extends vertically upwards from said second rod-like arm means.

5. The door guard of claim 1 including a coating of friction material surrounding said guard device to aid in frictionally retaining said device on said door and prevent marring of door surfaces.

6. The door guard of claim 1 wherein:

said leg means comprising a first vertically depending leg and a second vertically depending leg spaced from said first depending leg; and the distance from said first depending leg to said second rod-like arm means being less than the distance from said doorknob shank to said doorjamb so that there is a loose tolerance in the fit of said door guard between said door and door frame facilitating quick placement and removal of said door guard.

7. The door guard of claim 6 wherein said second elongated arm has a length greater than the distance from said door to said front facing of said door frame so that there is a loose tolerance in the fit of said guard device to said door to fit a variety of door and door frame types while still serving as a locking device when in place.

8. A door guard for locking a door of a mobile home and the like which opens outwardly of an interior space, said door having a door frame surrounding said door, a side doorjamb perpendicular to said door, a doorknob carried by said door which doorknob has a doorknob shank extending into said door and a front facing parallel to said door, said device comprising:

a first elongated rod-like arm means;

spaced depending leg means integral with said first rod-like arm means for straddling said doorknob, said leg means having an opening less than the diameter of said doorknob to lock behind said doorknob;

a second elongated rod-like arm means integral with said first elongated with said first elongated rod-like arm means and joined perpendicular thereto;

a brace means extending vertically from said second elongated rod-like arm means for embracing said side said doorjamb while said second elongated rod-like arm means extends past said side doorjamb to said front facing of said frame to hold said device between said door and said frame; and a third elongated rod-like arm means joined perpendicular to said second elongated rod-like arm means for engaging said front facing of said wall means as said door is opened outwardly to prevent said door from being opened outwardly.

9. The door guard of claim 8 including a coating of friction material surrounding said guard device to aid in frictionally retaining said device on said door and prevent marring of door surfaces.

10. The door guard of claim 8 including a second brace means extending vertically from said third leg means for assisting in the holding of said device in place and prevention of said door from being opened outwardly.

11. The door guard of claim 8 wherein:

said first elongated rod-like arm means has a length from said leg means opening to said side doorjamb which is less than the distance from said doorknob shank to said side doorjamb to provide a loose fit and facilitate quick and easy change out for repeated in and out use and accommodate different door structure designs and dimensions.

12. The door guard of a door structure including a door which opens outwardly of a dwelling interior, a door frame surrounding said door having a doorjamb perpendicular to said door, and a front facing parallel to said door, said doorjamb terminating short of said front facing of said door frame, hinges carrying one side of said door secured to said door frame, a doorknob carried on said door adjacent a second opposing side of said door having a doorknob shank extending into said door, comprising:

a first rod-like arm means having a pair of spaced depending legs straddling said doorknob shank being narrowly spaced for retention behind an outside diameter of said doorknob;

a second rod-like arm means perpendicular to said first rod-like arm means abuting said side doorjamb of said side frame;

third rod-like arm means integral with said second rod-like arm means extending generally parallel to said front facing for engaging said front facing to prevent outward movement of said door;

brace means extending vertically from said second rod-like arm means bracing against said doorjamb while said second rod-like arm means extends past said doorjamb and terminates adjacent said front facing of said door frame for holding said second rod-like arm means in place; and a loose tolerance fit between said guard device and said door and door frame for quick placement and removal of said guard device while affording lockability.

13. The door guard of claim 12 wherein said loose tolerance fit is provided by dimensioning the distance between the depending leg closest to said doorjamb and said second rod-like arm means to be less than the distance from said doorknob shank to said doorjamb.

14. The door guard of claim 12 including a coating of friction material surrounding said guard device to assist in frictionally retaining said device in place on said doorknob and prevent marring of adjacent door and doorknob surfaces.

15. The door guard of claim 12 wherein said first, second, and third rod-like arm means are elongated.

* * * * *